US012807367B2

(12) United States Patent
Veseli

(10) Patent No.: US 12,807,367 B2
(45) Date of Patent: Nov. 24, 2026

(54) MULTI COMPONENT BOTTLE

(71) Applicant: Oscura, LLC, Herndon, VA (US)

(72) Inventor: Bekim Veseli, Las Vegas, NV (US)

(73) Assignee: Oscura, LLC, Herndon, VA (US)

( * ) Notice: Subject to any disclaimer, the term of this patent is extended or adjusted under 35 U.S.C. 154(b) by 0 days.

(21) Appl. No.: 19/202,311

(22) Filed: May 8, 2025

(65) Prior Publication Data

US 2025/0346394 A1 Nov. 13, 2025

Related U.S. Application Data

(60) Provisional application No. 63/645,230, filed on May 10, 2024.

(51) Int. Cl.

| | |
|---|---|
| ***B65D 8/00*** | (2006.01) |
| ***B65D 25/54*** | (2006.01) |
| *B65D 6/00* | (2006.01) |
| *B65D 6/02* | (2006.01) |
| *B65D 6/24* | (2006.01) |
| *B65D 6/26* | (2006.01) |

(52) U.S. Cl.

CPC ..... *B65D 15/24* (2013.01); *B65D 15/22* (2013.01); *B65D 25/54* (2013.01); *B65D 7/06* (2013.01); *B65D 7/32* (2013.01); *B65D 11/10* (2013.01); *B65D 11/1873* (2013.01); *B65D 2203/00* (2013.01)

(58) Field of Classification Search

CPC ..... B65D 15/24; B65D 15/22; B65D 11/10; B65D 11/1873; B65D 7/06; B65D 7/32; B65D 25/54; B65D 2203/00

USPC ..... 215/900

See application file for complete search history.

(56) References Cited

U.S. PATENT DOCUMENTS 4,239,032 A 12/1980 Irving
5,474,212 A * 12/1995 Ichikawa ..... B05B 11/0038 222/105
5,571,598 A 11/1996 Butler et al.
(Continued)

FOREIGN PATENT DOCUMENTS

EP 2692267 A1 2/2014

OTHER PUBLICATIONS

International Search Report and Written Opinion dated Jul. 18, 2025, from counterpart International Patent Application No. PCT/US2025/028294.

*Primary Examiner* — Nathan J Jenness
*Assistant Examiner* — Jennifer Castriotta
(74) *Attorney, Agent, or Firm* — DLA Piper LLP (US)

(57) ABSTRACT

A container including a frame having a neck configured to receive a cap. A first side may be attached to the frame by one or more first fasteners. The first side may include a first transparent panel in a first recess. A first seal may be disposed between the first transparent panel and a first raised lip of the frame that extends into the first recess. A second side may be attached to an opposing side of the frame by one or more second fasteners. The second side may include a second transparent panel in a second recess. A second seal may be disposed between the second transparent panel and a second raised lip of the frame that extends into the second recess. The first transparent panel may include a first decorative element embedded therein and the second transparent may include a second decorative element embedded therein.

20 Claims, 5 Drawing Sheets

(56) References Cited

U.S. PATENT DOCUMENTS

| | | | | |
|---|---|---|---|---|
| 7,121,431 | B2 * | 10/2006 | Duke | B65D 75/5883 222/183 |
| 2012/0181283 | A1 | 7/2012 | Wahl | |
| 2018/0282011 | A1 | 10/2018 | Evans | |
| 2025/0376301 | A1 * | 12/2025 | Aboabdo | B65D 41/0471 |

* cited by examiner

MULTI COMPONENT BOTTLE

TECHNICAL FIELD

The present disclosure relates generally to the field of containers for liquid, and more particularly to a container that is assembled from multiple component pieces fastened together. The container may be resealable may have transparent sides that allow for the viewing of the contents of the container and optionally one or more designs.

BACKGROUND

Metal beverage containers have increased in popularity as they provide several advantages over glass and plastic containers. Typically, they last longer than glass or plastic because they are corrosion and shatter resistant, and they do not leach chemicals when exposed to sun/heat. Further, most metals used for beverage containers are 100% recyclable.

However, all-metal containers have some drawbacks for consumer products as compared to glass and plastic containers. For example, all-metal containers do not allow consumers to view the liquid inside, which can be beneficial from a practical standpoint (e.g., to determine the volume of liquid in the container) and from an aesthetic standpoint (e.g., to display and market the contents of the container). Accordingly, there is a need for a metal container that incorporates transparent elements that allows for the display of the liquid contained within and optionally one or more designs.

SUMMARY

A container is described herein. The container may include a frame having a neck configured to receive a cap. A first side may be attached to the frame by one or more first fasteners. The first side may include a first transparent panel in a first recess. A first seal may be disposed between the first transparent panel and a first raised lip of the frame that extends into the first recess. A second side may be attached to an opposing side of the frame by one or more second fasteners. The second side may include a second transparent panel in a second recess. A second seal may be disposed between the second transparent panel and a second raised lip of the frame that extends into the second recess.

A method of forming a container is described herein. The method may include attaching a first side to a frame having a neck configured to receive a cap using one or more first fasteners. The first side may include a first transparent panel in a first recess, such that a first seal disposed between the first transparent panel and a first raised lip of the frame that extends into the first recess forms a water-tight seal. A second side may be attached to an opposing side of the frame using one or more second fasteners. The second side may include a second transparent panel in a second recess, such that a second seal disposed between the second transparent panel and a second raised lip of the frame that extends into the second recess forms a water-tight seal.

The first transparent panel may include a first decorative element embedded therein and the second transparent panel may include a second decorative element embedded therein.

The frame may include one or more frame openings that align with one or more first openings in the first side and one or more second openings in the second side.

The one or more first fasteners may extend through the one or more first openings into the one or more frame openings and the one or more second fasteners may extend through the one or more second openings into the one or more frame openings.

The one or more frame openings may be configured to accept a coupling nut on a side facing the first side. The one or more first fasteners and the one or more second fasteners may be threaded into the coupling nut. The one or more first fasteners may be shorter in length than the one or more second fasteners.

The one or more first openings and the one or more second openings may include a tongue that extends into a groove in the frame.

The first raised lip may include a curved outer surface that compliments a curved surface of the first recess and the second raised lip may include a curved outer surface that compliments a curved surface of the second recess. The first raised lip may include a groove to seat the first seal and the second raised lip may include a groove to seat the second seal.

BRIEF DESCRIPTION OF DRAWINGS

Other objects and advantages of the present disclosure will become apparent to those skilled in the art upon reading the following detailed description of exemplary embodiments and appended claims, in conjunction with the accompanying drawings, in which like reference numerals have been used to designate like elements, and in which:

The figures are for purposes of illustrating example embodiments, but it is understood that the inventions are not limited to the arrangements and instrumentality shown in the drawings. In the figures, identical reference numbers identify at least generally similar elements.

DETAILED DESCRIPTION

The present disclosure describes methods and apparatuses directed to a container that is assembled from multiple component pieces fastened together. The container may be resealable may have transparent sides that allow for the viewing of the contents of the container and optionally one or more designs.

Figure 1:
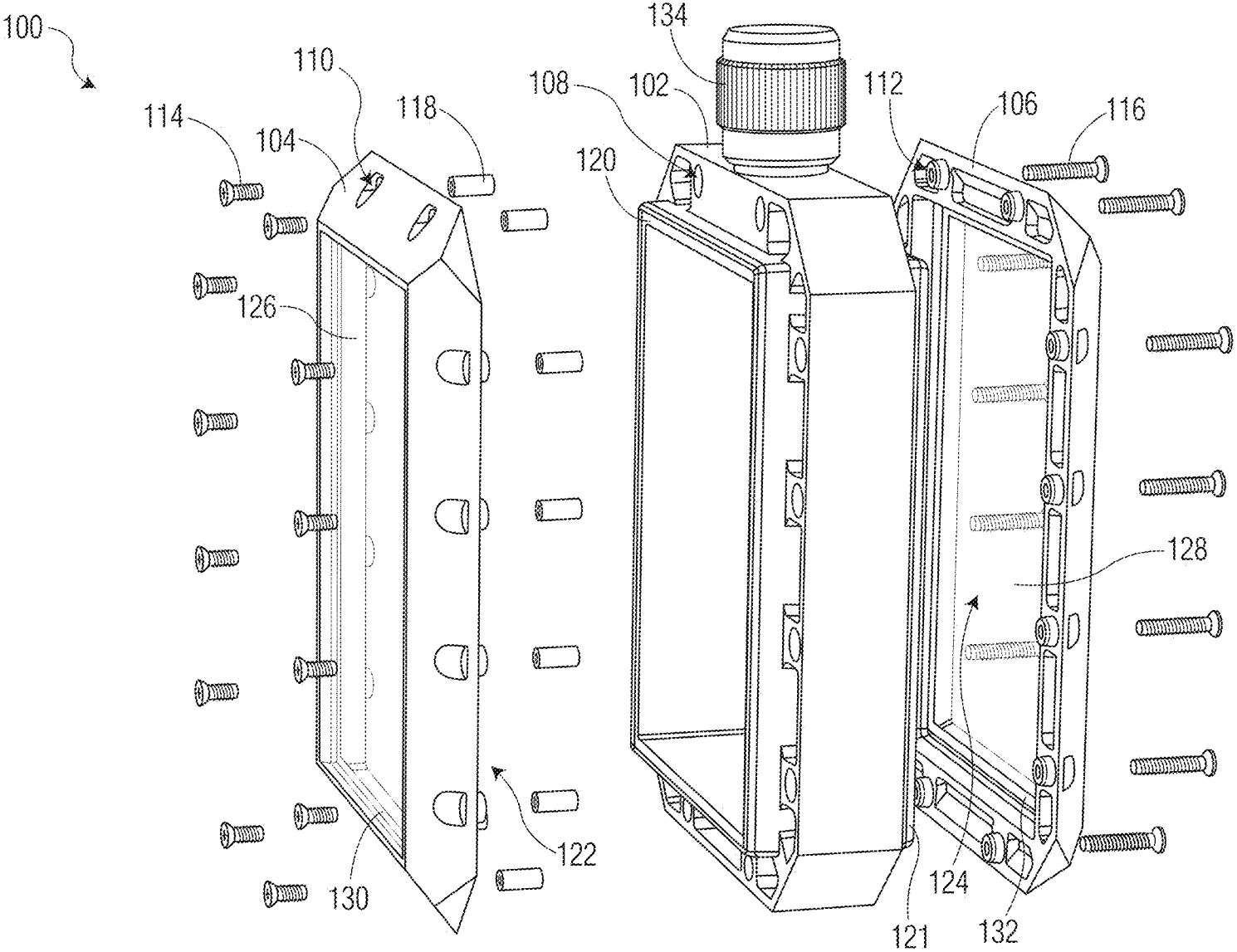
FIG. 1 is a perspective view illustrating a container having multiple components; according to an example of the present disclosure.

Referring now to FIG. 1, a perspective view illustrating a container 100 having multiple components is shown. The container 100 may include a frame 102, a first side 104, and a second side 106. In an example, the frame 102, the first side 104, and the second side 106 may be made of a food-safe metal or metal alloy, such as aluminum, stainless steel, and/or titanium. The frame 102, the first side 104, and the second side 106 may be formed through a casting process and/or one or more of computer numerical control (CNC) machining and three-dimensional (3D) printing.

The first side 104 and the second side 106 may be fastened to the frame 102 using one or more fasteners (e.g., bolts, screws, pins, etc.). The frame 102 may include one or more frame openings 108, the first side 104 may include one or more first openings 110, and the second side 106 may include one or more second openings 112 that are aligned and allow the one or more fasteners to insert therein. The one or more fasteners may include first fasteners 114 to secure the first side 104 to the frame 102 and second fasteners 116 to secure the second side 106 to the frame 102. In an example the first fasteners 114 and the second fasteners 116 may be of the same length and diameter. In another example, the first fasteners 114 may be shorter in length than the second fasteners 116.

In an example, the one or more frame openings 108 may be threaded, such that the first fasteners 114 and the second fasteners 116 may be secured directly by the one or more frame openings 108. In another example, the one or more frame openings 108 may be unthreaded and the first fasteners 114 and the second fasteners 116 may be screwed into one or more coupling nuts 118 that are fitted within the one or more frame openings 108. Heads of the first fasteners 114 may be recessed within the one or more first openings 110 and heads of the second fasteners 116 may be recessed within the one or more second openings 112.

The frame 102 may have a first raised lip 120 facing the first side 104 and a second raised lip facing the second side 106. The first raised lip 120 may fit within a first recess 122 of the first side 104 and the second raised lip 121 may fit within a second recess 124 of the second side 106. The first recess 122 may include a first transparent panel 126 and the second recess 124 may include a second transparent panel 128. The first transparent panel 126 and the second transparent panel 128 may be made of one or more of glass, a plastic, or a thermoplastic polymer (e.g., polycarbonate). The first transparent panel 126 and the second transparent panel 128 may be substantially flat. In an example, the first transparent panel 126 and the second transparent panel 128 may be press fit into the respective first recess 122 and the second recess 124, such that they are in direct contact with the respective first side 104 and second side 106. Alternatively, the first transparent panel 126 and the second transparent panel 128 may attached to the respective first side 104 and second side 106 using an adhesive.

A first seal 130 may be located between the first transparent panel 126 and the first raised lip 120 to ensure a water-tight seal between the first transparent panel 126 and the first raised lip 120 when the first side 104 is secured to the frame 102. A second seal 132 may be located between the second transparent panel 128 and the second raised lip 121 to ensure a water-tight seal between the second transparent panel 128 and the second raised lip 121 when the second side 106 is secured to the frame 102. The first seal 130 and the second seal 132 may be made of different materials and/or have different shapes or they may be made of the same material and have the same shape. In an example, one or more of the first seal 130 and the second seal 132 may be a gasket. In another example, one or more of the first seal 130 and the second seal 132 may be an o-ring. One or more of the first seal 130 and the second seal 132 may be an elastomer, such as nitrile, neoprene, ethylene propylene (EPDM) rubber, silicone, fluorocarbon, and polytetrafluoroethylene (PTFE).

A cap 134 may be affixed to a neck (not shown) of the frame 102. An inner surface of the cap 134 and an outer surface of the neck may have complementary threads that allows the cap 134 to be tightened down to provide a resealable water-tight seal.

Figure 2:
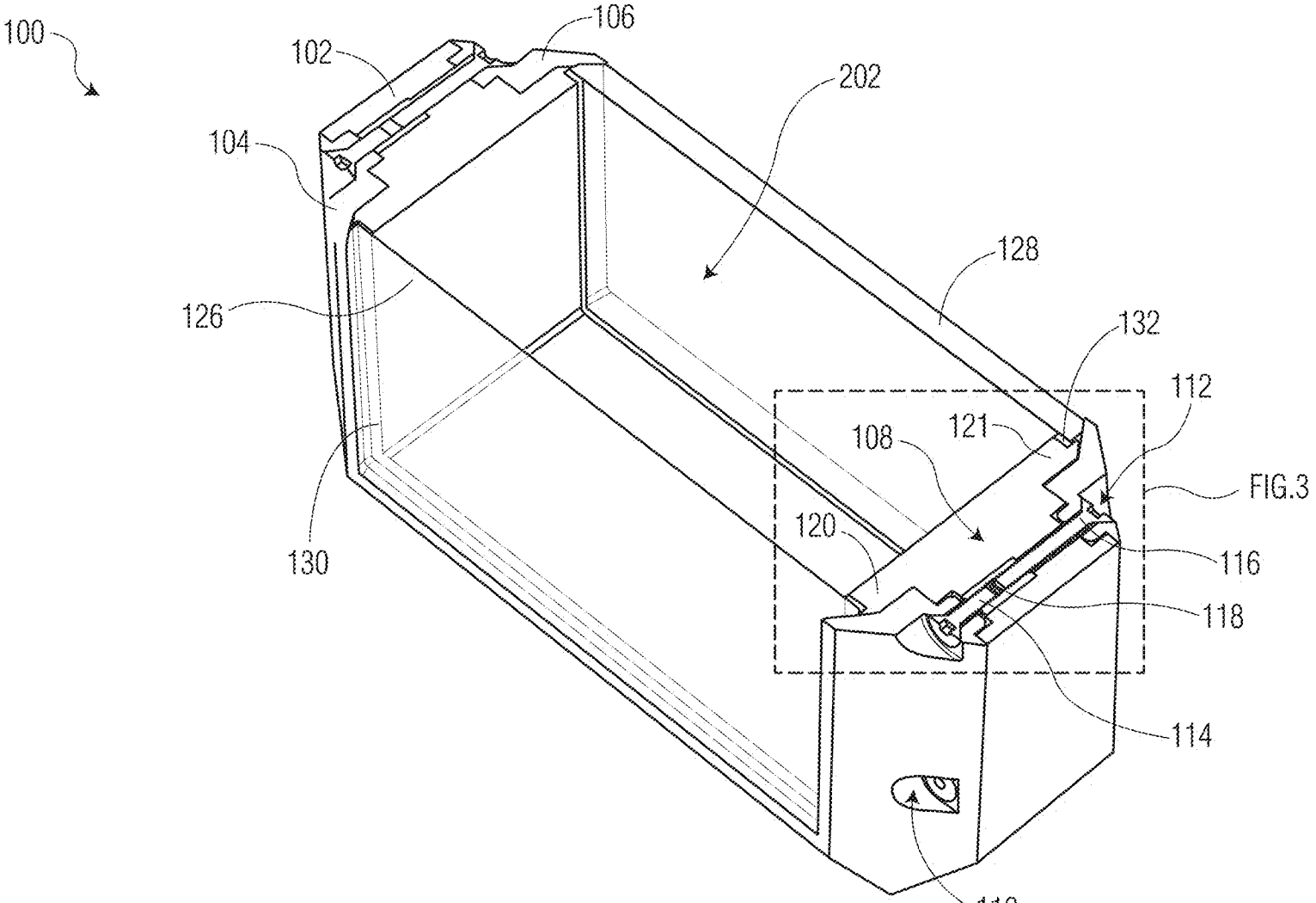
FIG. 2 is a section view of the container showing a first side and s second side 106 fastened to the frame to form an interior space, according to an example of the present disclosure.

Referring now to FIG. 2, a section view of the container 100 showing the first side 104 and the second side 106 fastened to the frame 102 to form an interior space 202 is shown. The interior space 202 may be defined by interior surfaces of the frame 102, an interior surface of the first transparent panel 126, and an interior surface of the second transparent panel 128. As described above, the first side 104 may be secured to the frame 102 via the first fasteners 114 and the second side 106 may be secured to the frame 102 via the second fasteners 116. The first fasteners 114 may extend through the one or more first openings 110 in the first side 104 into the one or more frame openings 108 in the frame 102. The second fasteners 116 may extend through the one or more second openings 112 in the second side 106 into the one or more frame openings 108 in the frame 102.

The one or more frame openings 108 may house the one or more coupling nuts 118 that the first fasteners 114 and the second fasteners 116 thread into. The one or more frame openings 108 may be wider on the side adjacent to the first side 104 to accommodate a diameter of the one or more coupling nuts 118.

The first raised lip 120 may extend into the first recess 122 of the first side 104 and the second raised lip 121 may extend into the second recess 124 of the second side 106. Once the first side 104 is secured to the frame 102 via the first fasteners 114, the first seal 130 may be compressed between the first transparent panel 126 and the first raised lip 120, thereby forming a water-tight seal. Similarly, once the second side 106 is secured to the frame 102 via the second fasteners 116, the second seal 132 may be compressed between the second transparent panel 128 and the second raised lip 121, thereby forming a water-tight seal.

Figure 3:
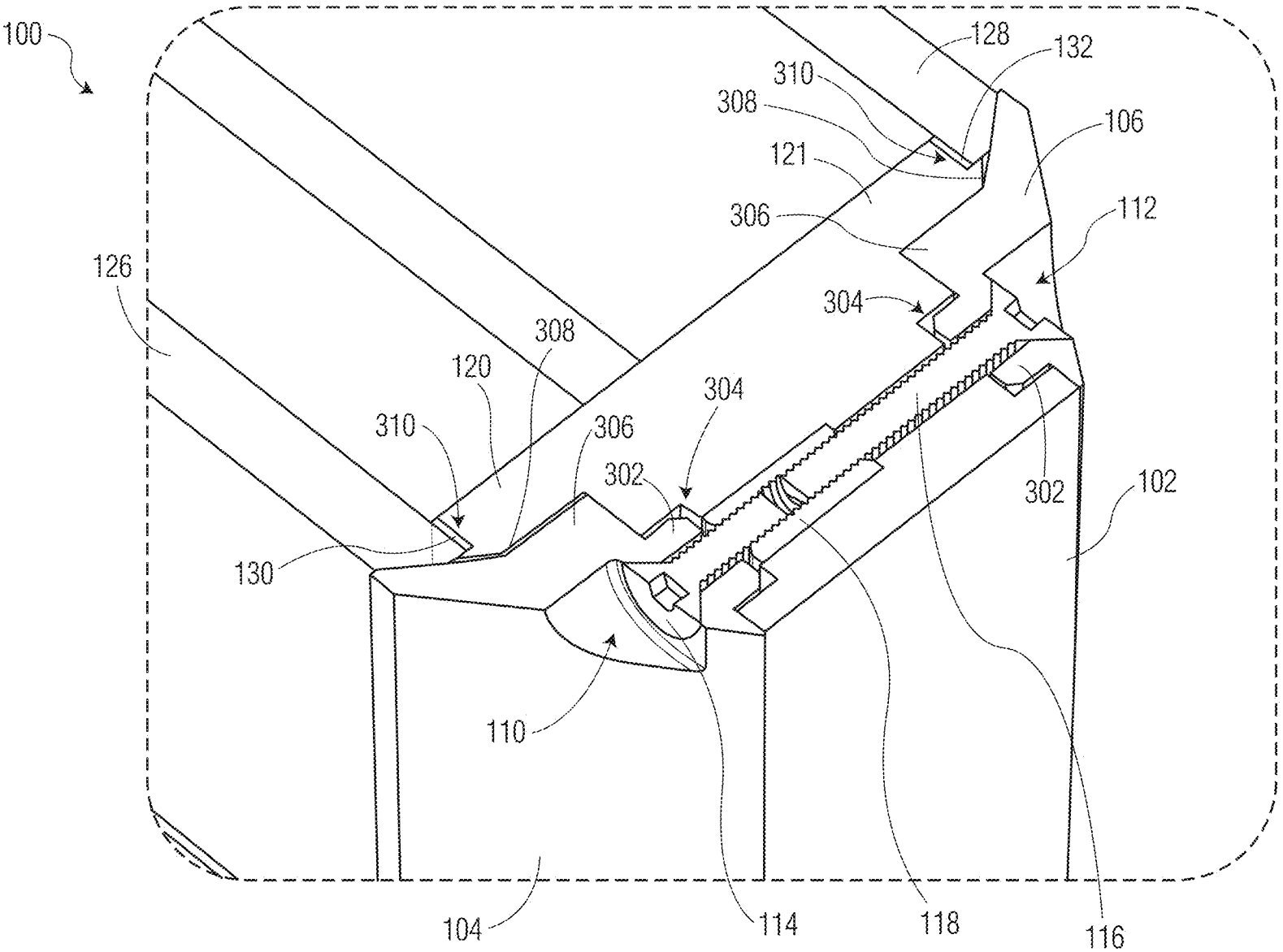
FIG. 3 is a section view showing the fitment of the frame, the first side, and the second side once fastened, according to an example of the present disclosure.

Referring now to FIG. 3, a section view showing the fitment of the frame 102, the first side 104, and the second side 106 once fastened is shown. The first side 104 and the second side 106 may be shaped such that they are complimentary to a shape of the frame 102. For example, the one or more first openings 110 and the one or more second openings 112 may have a tongue 302 that protrudes from a respective inner surface of the first side 104 and inner surface of the second side 106 that fits into a groove 304 of the frame 102. Further, the first side 104 and the second side 106 may be stepped, such that a shoulder 306 extends to a base of the first raised lip 120 and the second raised lip 121. The shoulder 306 may extend to a base of the tongue 302.

The first raised lip 120 and the second raised lip 121 may have an exterior surface 308 that is curved to compliment as curved surface of the respective first recess 122 and the second recess 124. Further, the first raised lip 120 and the second raised lip 121 may include a groove 310 to seat the respective first seal 130 and second seal 132.

Figure 4B:
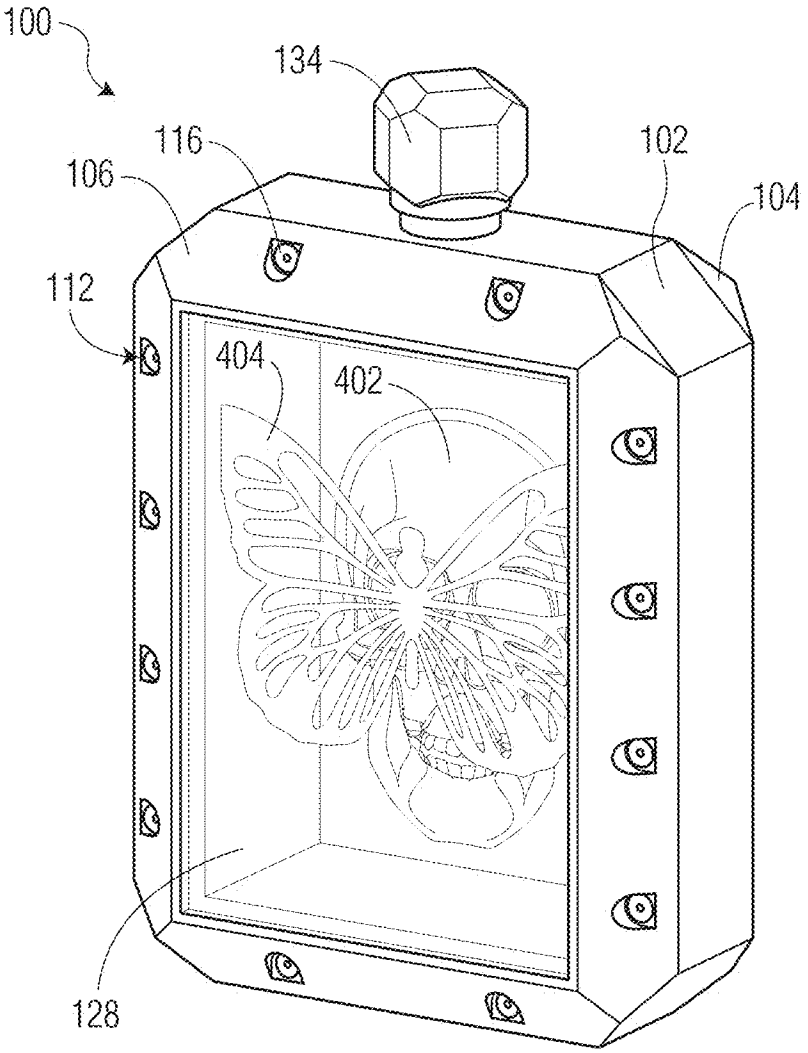
FIGS. 4A-4B are perspective views of the assembled container with exemplary design elements, according to an example of the present disclosure.
Figure 4A:
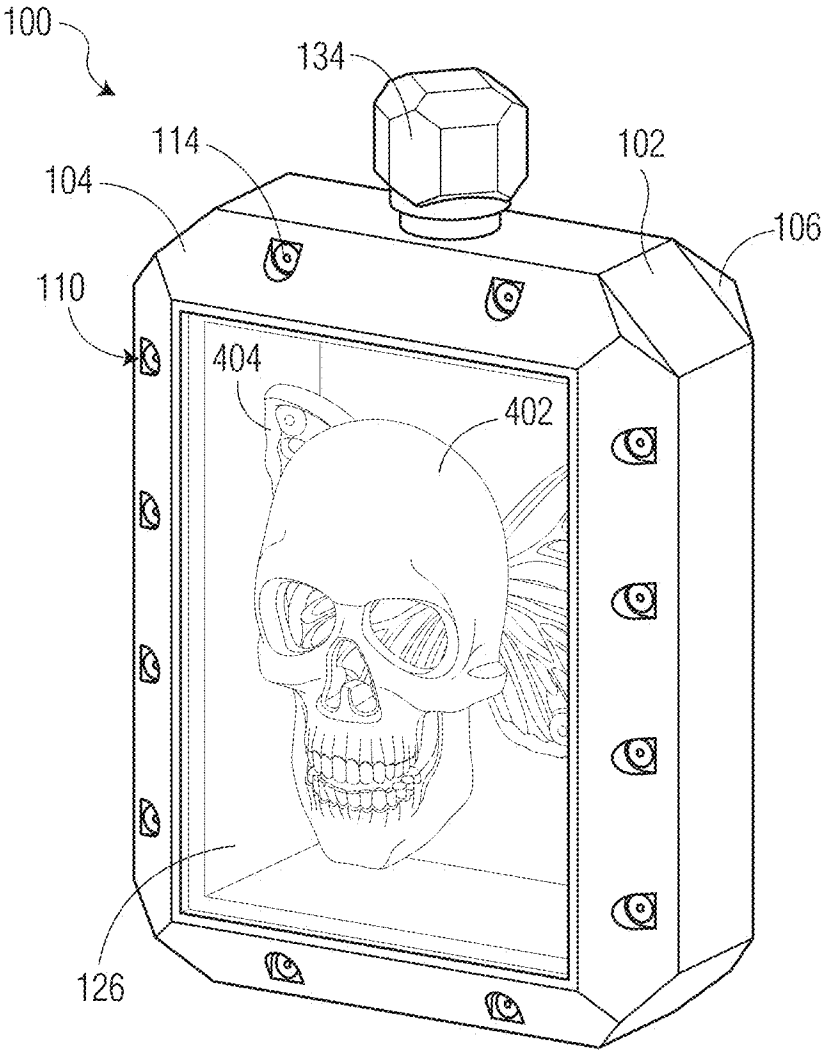

Referring now to FIGS. 4A-4B, perspective views of the assembled container 100 with exemplary design elements are shown. In the example shown, a first design element 402 may be embedded in or affixed/applied to the first transparent panel 126 to face outwards from the first side 104. A second design element 404 may be embedded in or affixed/applied to the second transparent panel 128 to face outwards from the second side 106. A back side of the second design element 404 may be visible through the first transparent panel 126. Similarly, a back side of the first design element 402 may be visible through the second transparent panel 128. It should be noted the above configuration can apply to either side of the container 100.

Figure 5B:
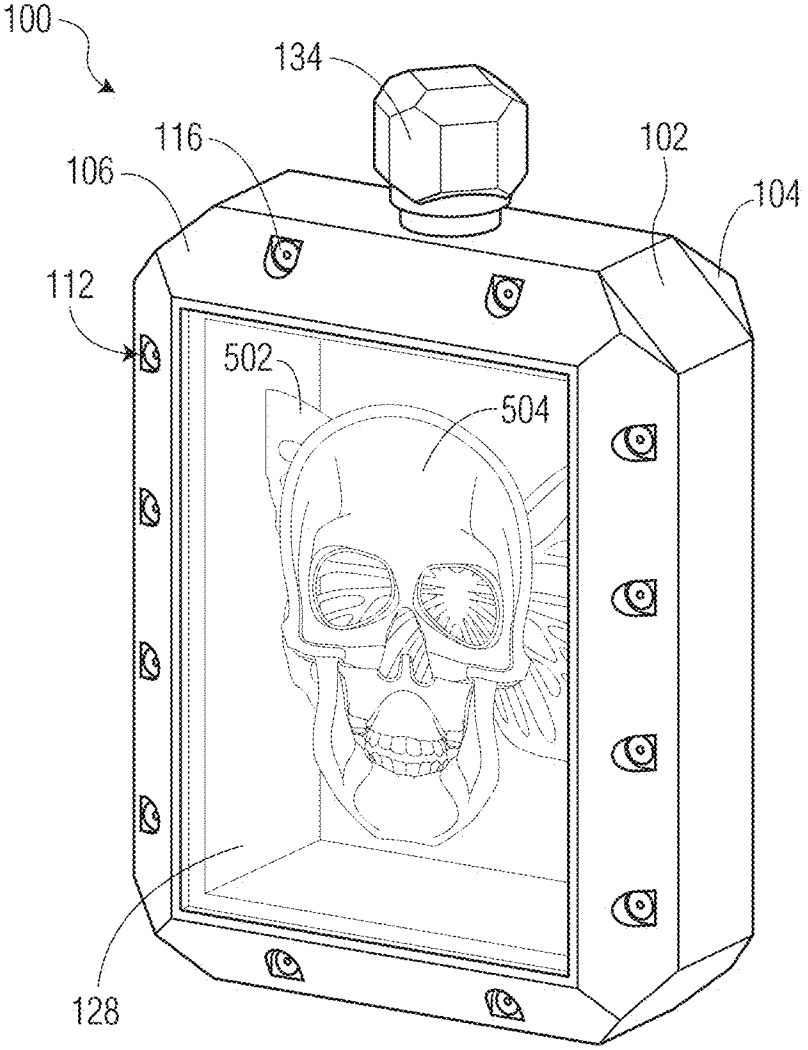
FIGS. 5A-5B are perspective views of the assembled container with exemplary design elements, according to an example of the present disclosure.
Figure 5A:
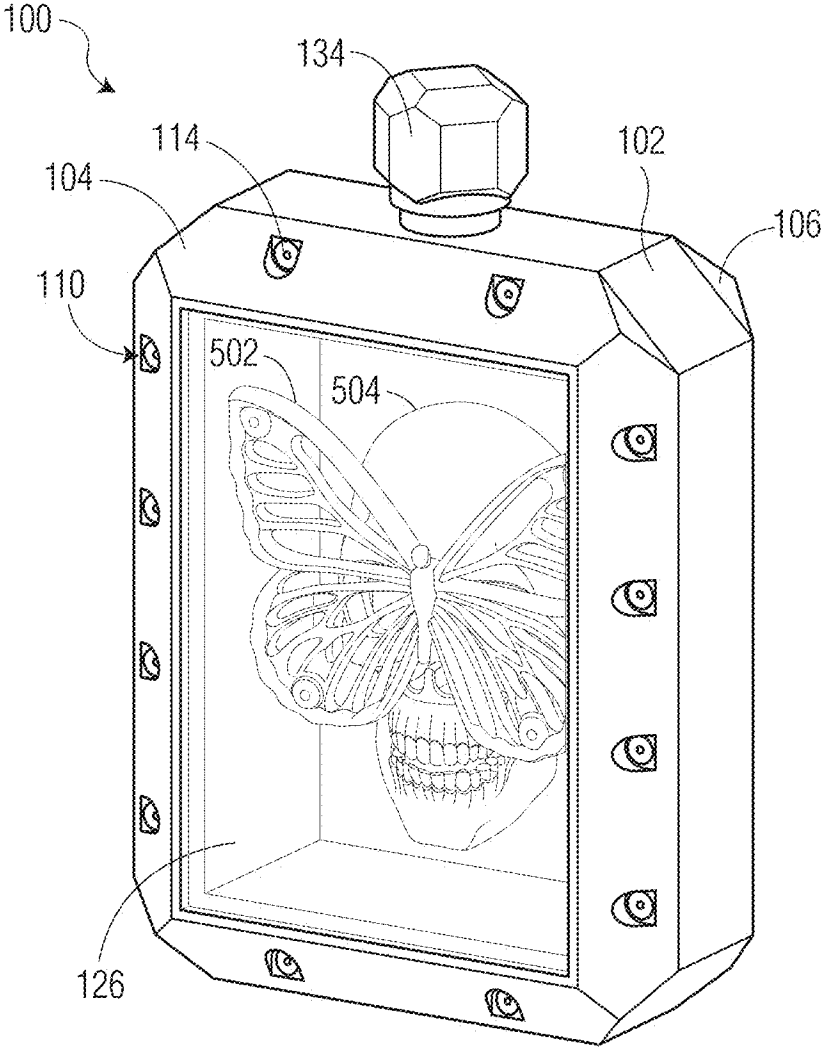

Referring now to FIGS. 5A-5B, perspective views of the assembled container 100 with exemplary design elements are shown. In the example shown, a first design element 502 may be embedded in or affixed/applied to the first transparent panel 126 to face outwards from the first side 104. A second design element 504 may be embedded in or affixed/applied to the second transparent panel 128 to face inwards from the second side 106. In this manner both a front side of the first design element 502 and a front side of the second design element 504 may both be visible through the first transparent panel 126. Similarly, a back side of the first design element 502 and a back side of the second design element 504 may be visible through the second transparent panel 128. It should be noted the above configuration can apply to either side of the container 100.

Additional examples of the presently described method and device embodiments are suggested according to the structures and techniques described herein. Other non-limiting examples may be configured to operate separately or may be combined in any permutation or combination with any one or more of the other examples provided above or throughout the present disclosure. Components and/or arrangement of components illustrated in one figure may be incorporated into any other figure.

It will be appreciated by those skilled in the art that the present disclosure may be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The terms "including" and "comprising" should be interpreted as meaning "including, but not limited to." If not already set forth explicitly in the claims, the term "a" should be interpreted as "at least one" and the terms "the, said, etc." should be interpreted as "the at least one, said at least one, etc."

It is the Applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A container comprising:

a frame having a neck configured to receive a cap;

a first side attached to the frame by one or more first fasteners, the first side comprising a first transparent panel in a first recess;

a first seal disposed between the first transparent panel and a first raised lip of the frame, the first raised lip extending into the first recess;

a second side attached to an opposing side of the frame by one or more second fasteners, the second side comprising a second transparent panel in a second recess; and a second seal disposed between the second transparent panel and a second raised lip of the frame, the second raised lip extending into the second recess.

2. The container of claim 1, wherein the frame comprises one or more frame openings that align with one or more first openings in the first side and one or more second openings in the second side.

3. The container of claim 2, wherein the one or more first fasteners extend through the one or more first openings into the one or more frame openings and the one or more second fasteners extend through the one or more second openings into the one or more frame openings.

4. The container of claim 3, wherein the one or more frame openings are configured to accept a coupling nut on a side facing the first side.

5. The container of claim 4, wherein the one or more first fasteners and the one or more second fasteners are threaded into the coupling nut.

6. The container of claim 5, wherein the one or more first fasteners are shorter in length than the one or more second fasteners.

7. The container of claim 2, wherein the one or more first openings and the one or more second openings comprise a tongue that extends into a groove in the frame.

8. The container of claim 1, wherein the first raised lip comprises a curved outer surface that complements a curved surface of the first recess and the second raised lip comprises a curved outer surface that compliments a curved surface of the second recess.

9. The container of claim 1, wherein the first raised lip comprises a groove to seat the first seal and the second raised lip comprises a groove to seat the second seal.

10. The container of claim 1, wherein the first transparent panel comprises a first decorative element embedded therein and the second transparent panel comprises a second decorative element embedded therein.

11. A method of forming a container comprising:

attaching a first side to a frame having a neck configured to receive a cap using one or more first fasteners, the first side comprising a first transparent panel in a first recess, such that a water-tight seal is formed by a first seal disposed between the first transparent panel and a first raised lip of the frame, wherein the first raised lip extends in to the first recess; and attaching a second side to an opposing side of the frame using one or more second fasteners, the second side comprising a second transparent panel in a second recess, such that a water-tight seal is formed by a second seal disposed between the second transparent panel and a second raised lip of the frame, wherein the second raised lip extends in to the second recess.

12. The method of claim 11, wherein the frame comprises one or more frame openings that align with one or more first openings in the first side and one or more second openings in the second side.

13. The method of claim 12, wherein the one or more first fasteners extend through the one or more first openings into the one or more frame openings and the one or more second fasteners extend through the one or more second openings into the one or more frame openings.

14. The method of claim 13, wherein the one or more frame openings are configured to accept a coupling nut on a side facing the first side.

15. The method of claim 14, wherein the one or more first fasteners and the one or more second fasteners are threaded into the coupling nut.

16. The method of claim 15, wherein the one or more first fasteners are shorter in length than the one or more second fasteners.

17. The method of claim 12, wherein the one or more first openings and the one or more second openings comprise a tongue that extends into a groove in the frame.

18. The method of claim 11, wherein the first raised lip comprises a curved outer surface that compliments a curved surface of the first recess and the second raised lip comprises a curved outer surface that complements a curved surface of the second recess.

19. The method of claim 11, wherein the first raised lip comprises a groove to seat the first seal and the second raised lip comprises a groove to seat the second seal.

20. The method of claim 11, wherein the first transparent panel comprises a first decorative element embedded therein and the second transparent panel comprises a second decorative element embedded therein.

* * * * *